United States Patent [19]

Peterson

[11] 4,291,874

[45] Sep. 29, 1981

[54] FINGER TWIRLED TOY WITH BALANCING MASS

[76] Inventor: Mark Peterson, 20 S. Pontiac Dr., Janesville, Wis. 53545

[21] Appl. No.: 88,163

[22] Filed: Oct. 25, 1979

[51] Int. Cl.[3] ..... A63B 71/00

[52] U.S. Cl. ..... 273/1 GF; 273/414; D21/102

[58] Field of Search ..... 273/1 R, 1 E, 1 M, 319–321, 273/, 329, 330, 414, 413, 1 GF; 46/51, 52; D21/102

[56] References Cited

U.S. PATENT DOCUMENTS

| | | | |
|---|---|---|---|
| 3,015,908 | 1/1962 | Colletti | 273/1 R X |
| 3,130,517 | 4/1964 | Green | 46/51 |
| 3,484,985 | 12/1969 | Castell | 273/1 R X |
| 3,829,087 | 8/1974 | Kuney | 273/1 R |
| 4,040,205 | 8/1977 | Taylor | 273/1 R X |

FOREIGN PATENT DOCUMENTS

| | | | |
|---|---|---|---|
| 47-5990 | 2/1972 | Japan | 273/1 R |
| 20938 | of 1893 | United Kingdom | 273/1 R |
| 943312 | 12/1963 | United Kingdom | 273/330 |

OTHER PUBLICATIONS

Seventeen Magazine, 8–1966, p. 276, Hang on to Hangers.

*Primary Examiner*—Paul E. Shapiro

*Attorney, Agent, or Firm*—Isaksen, Lathrop, Esch, Hart & Clark

[57] ABSTRACT

A toy adapted to be twirled on the finger of a user. The toy has a manipulating ring adapted to encircle the finger of the user of the toy, a connector extending from the manipulating ring for a selected distance, a substantially ring-shaped pedestal holder connected to the connector at a point remote from the primary manipulating ring, and a substantially spherical pedestal attached to the pedestal holder at a point substantially facing the manipulating ring. A balancing mass is adapted to balance on the pedestal, and a retaining loop is fastened to the balancing mass and looped through the pedestal holder, whereby the balancing mass is prevented from falling free from the toy when it is not balanced on the pedestal. A user places the balancing mass on the pedestal and twirls the toy without disturbing the balancing mass, which is held in place by centrifugal force.

14 Claims, 5 Drawing Figures

FINGER TWIRLED TOY WITH BALANCING MASS

BACKGROUND OF THE INVENTION

1. Field of the Invention

This invention relates to toys and more particularly to toys adapted to be twirled on the finger while an object is balanced on an outer balancing point of the toy.

2. Description of the Prior Art

It is well known that a moving object tends to travel in a straight line unless subjected to a force applied at an angle to the direction of travel. When such a force is applied, the object is deflected and follows a curved path until the deflecting force is no longer applied.

This principle is illustrated in many toys. A child in a swing is forced to travel in a semi-circular path by the force exerted against his body by the swing on which he sits. Similarly, the familiar childhood trick of swinging a pail of water around one's head without spilling the water works because the pail exerts a force on the water causing it to travel in a substantially circular path as the pail is swung. In order to avoid a drenching, the person swinging the pail must keep it moving fast enough so that, as the water is swung up towards the top of the circular path, the force of gravity does not have sufficient time to accelerate the water downward until the upward vertical component of its motion is reduced to zero and the water falls free of the pail.

Prior art toys exist that operate on principles similar to those illustrated by the example of water in a pail but in which a rigid framework is substituted for the pail and small, solid objects are substituted for the water. Examples are discussed in *Taylor,* U.S. Pat. No. 4,040,205, *Kuney,* U.S. Pat. No. 3,829,087, *Castell,* U.S. Pat. No. 3,484,985, and *Colletti,* U.S. Pat. No. 3,015,908. The toys illustrated in each of these patents employ rigid frames on which an object may be balanced and which may be rotated about a point on the frame remote from the balanced object. The object in Colletti rests in a depression formed in the frame. Taylor, Kuney, and Castell each show the balanced object resting on a pedestal that is substantially cylindrical with a flattened end that is upward facing when the toy is in the rest position. The pedestals shown in all of the prior art toys are relatively narrow structures that might well scratch or snag a person's flesh or clothing, furniture, or any other object with which they might collide if accidentally thrown.

Taylor and Kuney provide for the retention of the balanced objects should they slip off their pedestals. Taylor shows a flexible, thread-like member attached to the upper surface of each disc-shaped object to be balanced and extending therefrom to a point on the frame where the thread-like member may be attached. The objects in Kuney are so arranged that they fall into a cup-like retaining vessel should they slip off the pedestal. The arrangement shown in Kuney, while providing some safeguards against the danger of flying objects, nevertheless fails to positively secure the objects to the framework of the toy. An accidental flipping of the toy off the finger of the user could lead to the loss of the objects or to their striking a person standing in the vicinity. The thread-like members shown in Taylor avoid these difficulties. However, each end of the thread must be attached to a solid object, creating two points at which repeated bending could lead to a failure of material and consequent loss of the balanced object.

SUMMARY OF THE INVENTION

The device of the invention is adapted to be twirled on a finger of a user and has a primary manipulating ring adapted to encircle the finger of the user of the toy in freely slidable relation, a connector extending from the primary manipulating ring for a selected distance and rigidly connected thereto, a substantially ring-shaped primary pedestal holder rigidly connected to the connector at a point remote from the primary manipulating ring, a substantially spherical pedestal rigidly attached to the primary pedestal holder so as to substantially face the primary manipulating ring, a balancing mass adapted to balance on the pedestal in removable relation, and a retaining loop of flexible material fastened to the balancing mass and looped through the primary pedestal holder, whereby the balancing mass is prevented from falling free from the toy when it is not balanced on the pedestal.

A primary object of the invention is to provide a toy requiring physical skill and coordination for its use.

A second object of the invention is to provide a toy in which a balancing mass may be balanced on a pedestal while the toy is twirled by a user.

Another object of the invention is to provide reliable means for preventing the balancing mass from flying free of the toy while the toy is being twirled.

Yet another object of the invention is to provide a pedestal on which the balancing mass may be balanced that is adapted not to scratch or puncture the skin of the user or other surrounding materials with which it might come in contact.

A further object of the invention is to provide a pedestal having a point contact with the balancing mass without having the impractically difficult and dangerous characteristics of a sharply pointed pedestal.

Other objects, features, and advantages of the invention will be apparent from the following detailed description taken in conjunction with the accompanying drawings showing preferred embodiments of the invention.

DESCRIPTION OF THE PREFERRED EMBODIMENT

Figure 1:
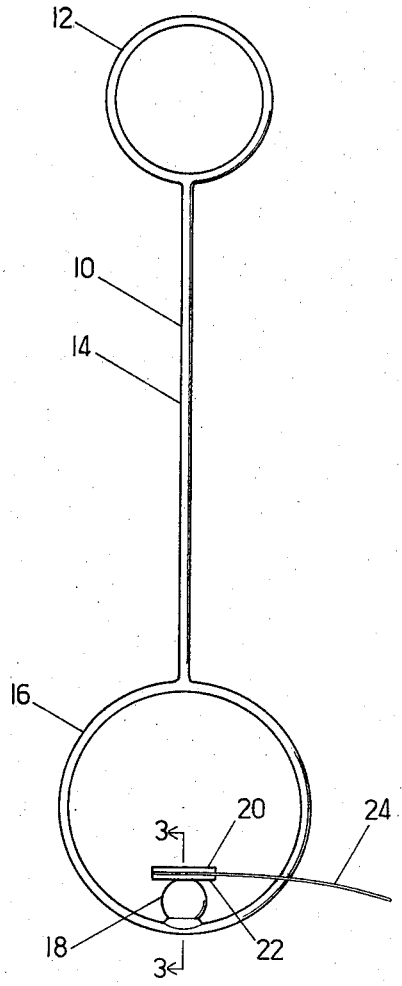
FIG. 1 is a front elevation view of the toy of the invention with the balancing mass balanced on the pedestal.
Figure 2:
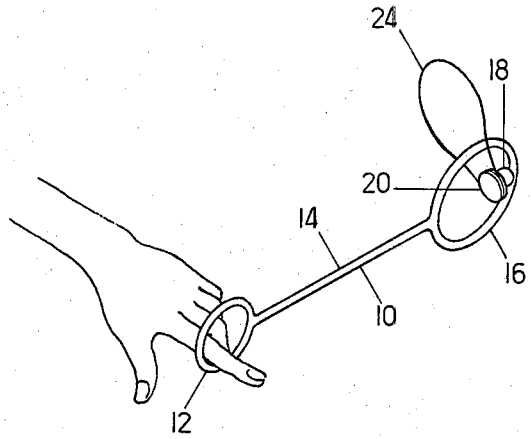
FIG. 2 is a perspective view of the embodiment shown in FIG. 1 being twirled on the finger of a user.
Figure 3:
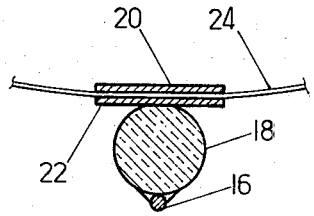
FIG. 3 is a cross-sectional view of the balancing mass, pedestal, and contiguous portion of the primary pedestal holder of the embodiment shown in FIG. 1, taken along section lines 3—3 of FIG. 1.
Figure 4:
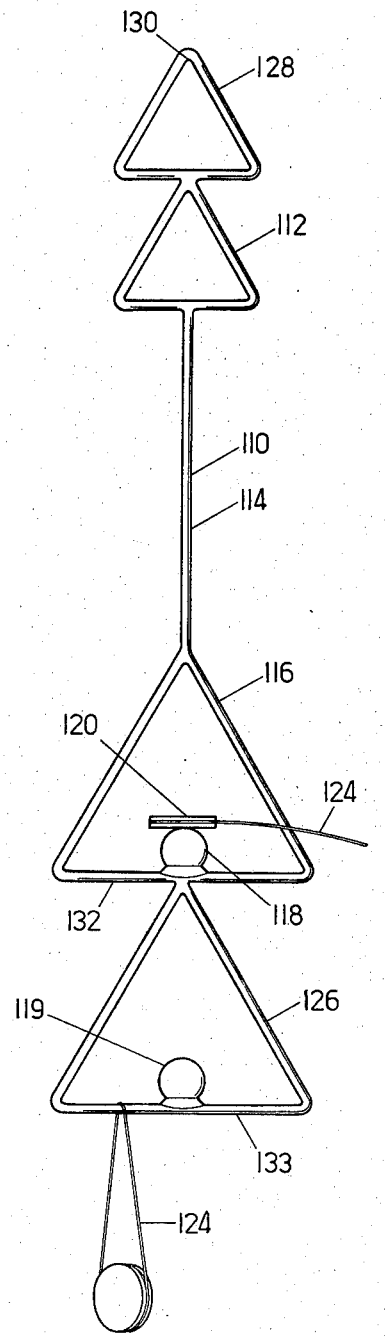
FIG. 4 is a front elevation view of a second embodiment of the toy of the invention.
Figure 5:
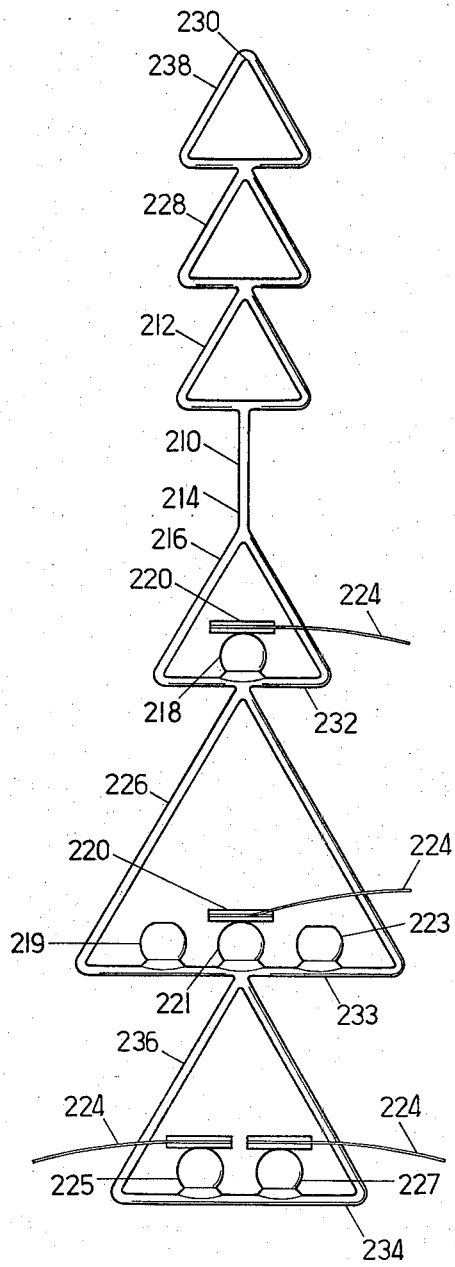
FIG. 5 is a front elevation view of a third embodiment of the toy of the invention.

Referring more particularly to the drawings, wherein like numbers refer to like parts in each view, FIGS. 1 and 2 illustrate a preferred embodiment of my novel toy adapted to be twirled on a finger of a user, shown generally at 10. FIGS. 4 and 5 show a second and third embodiment respectively of the toy of the invention. Insofar as the parts of those embodiments correspond to parts in the first embodiment, illustrated in FIGS. 1 and 2, the same reference number is used to identify them, except that, when applied to the embodiments shown in FIGS. 4 and 5, that reference number is increased by 100 and 200 respectively. Such parts so numbered have structures and functions that correspond to those of the equivalent parts in the embodiment shown in FIGS. 1 and 2 and will not be separately discussed herein.

The embodiment of the toy shown at 10 in FIGS. 1 and 2 has a primary manipulating ring 12 adapted to encircle the finger of the user of the toy in freely slidable relation in the manner illustrated in FIG. 2. A connector 14 extends from the primary manipulating ring 12 for a selected distance and is rigidly connected thereto. Preferably, the connector 14 is straight, circular in cross-section, and rigid. However, connectors having curved or other shapes or noncircular cross-sectional shapes or made of flexible materials remain within the scope and spirit of the invention. A substantially ring-shaped primary pedestal holder 16 is rigidly connected to the connector 14 at a point remote from the primary manipulating ring 12. A pedestal 18 is rigidly attached to the primary pedestal holder 16 at a point substantially facing the primary manipulating ring 22. The pedestal 18 may be columnar with a substantially flat end facing the primary manipulating ring, but preferably the pedestal is substantially spherical in shape.

A balancing mass 20 is adapted to balance on the pedestal 18 in removable relation. The balancing mass 20 is preferably a weighted disc having at least one flat underside 22 which may be selected to be in contact with the pedestal 18. However, other shapes may be used for the balancing mass 20, and the underside 22 may have a depression or other surface feature adapted to slidably engage the pedestal, all without departing from the spirit and scope of the invention. Preferably, a retaining loop 24 is fastened to the balancing mass 20 and looped through the primary pedestal holder 16 so as to prevent the balancing mass from falling free of the toy should it slip off of the pedestal.

Preferably the retaining loop 24 is made of a flexible material having a low density, such as nylon filament. In the preferred embodiment, the balancing mass with its associated retaining loop is made by sandwiching the ends of a length of nylon filament between two metal discs to create a closed loop. The loop and discs are fastened to each other with an appropriate adhesive. When the balancing mass is not balanced on the pedestal and is prevented from falling free of the toy by the retaining loop, the weight of the balancing mass is distributed between the two ends of the length of nylon filament constituting the loop. Consequently, no single point on the retaining loop must bear all of the stress of the sharp jerk experienced by the retaining loop as the fall of the balancing mass is arrested by the loop. As a result, the danger of breakage of the retaining loop is reduced. Although this desirable feature is part of the preferred embodiment of the invention, a retaining loop attached to the balancing mass by other means remains within the spirit and scope of the invention.

As illustrated in the embodiment shown in FIG. 4, at least one secondary pedestal holder 126 may be rigidly connected to the primary pedestal holder 116 at a point substantially opposed to the primary manipulating ring 112. As illustrated in the embodiment shown in FIG. 5, at least two secondary pedestal holders 226 and 236 may be rigidly connected in a substantially linear array with the substantially linear array then being attached rigidly to the primary pedestal holder 216 at a point substantially opposed to the primary manipulating ring 212.

A secondary manipulating ring 128 may be attached rigidly to the primary manipulating ring 112 at a point substantially opposed to the primary pedestal holder 116, as illustrated in FIG. 4. Furthermore, at least two secondary manipulating rings 228 and 238 may be connected rigidly in a substantially linear array, the substantially linear array being attached rigidly to the primary manipulating ring 212 at a point substantially opposed to the primary pedestal holder 216, as illustrated in FIG. 5.

When the underside 22 of the balancing mass 20 is substantially flat, as is the case in the preferred embodiment of the invention, and when the substantially spherical pedestal 18 is in contact therewith, the balancing mass 20 is in contact with the pedestal only at the single point of intersection of a plane defined by the underside 22 and the sphere defined by the surface of the pedestal 18. Consequently, considerable skill is required to establish and maintain the balanced position. It will be appreciated that should the balancing mass be imperfectly balanced, it will tip slightly until its center of gravity is above the point at which it is in contact with the pedestal beneath. If this relationship is established before the frictional forces tending to prevent the balancing mass from slipping off the pedestal are exceeded, the balancing mass will be retained on the pedestal. Consequently, though difficult, it is possible to achieve the necessary balance even with only a single point contact. In contrast, if the end of the pedestal were fashioned into a needle-like point in order to obtain a single point contact with the balancing mass, a user attempting to position the balancing mass would face a challenge impossible for all practical purposes.

The degree of difficulty presented by the toy of the present invention may be modified in several ways. The balancing mass 20 may be stabilized on the pedestal 18 by slightly flattening the top of the substantially spherical pedestal 18 to increase the surface contact between the pedestal and the balancing mass 20 to the desired extent. Furthermore, more than one pedestal may be included in a particular toy embodying the present invention. If one or more secondary pedestal holders are used, as shown at 126 in FIG. 4 and at 226 and 236 in FIG. 5, each may have its own pedestal and associated balancing mass. In addition, more than one pedestal may be attached to a single pedestal holder, as shown in FIG. 5. The difficulty presented to the user of the toy increases significantly as the number of pedestals with associated balancing masses is increased. Where a single pedestal holder is provided with more than one pedestal, the pedestals may be flattened to differing degrees, as illustrated in FIG. 5 at 219, 221, and 223, for use with a single balancing mass. By selecting the particular pedestal on which to place the balancing mass, a user may in turn select the degree of difficulty he wishes to encounter. Furthermore, when the toy of the invention is equipped with one or more secondary manipulating rings, as described above, the difficulty of successfully twirling the toy without disturbing the balance of the balancing masses increases as the user selects a manipulating ring increasingly near to the center of gravity of the toy, as the effective moment arm between the center of rotation and the balancing masses decreases.

The manipulating rings may be substantially circular, as is the primary manipulating ring 12 of the embodiment shown in FIG. 1. However, both the primary manipulating ring and any secondary manipulating rings may be of a selected straight-sided geometric shape having points of intersection between contiguous sides and so oriented relative to the connector that a selected point of intersection between two of the sides is substantially opposed to the primary pedestal holder so as to form a twirling point, as shown at 130 and 230 in FIGS. 4 and 5 respectively. The primary and secondary manipulating rings of the embodiments shown in FIGS. 4 and 5 are illustrations of the use of such a straight-sided geometric shape. Because the straight sides that intersect to form the twirling point tend to stabilize the position of the finger within the manipulating ring relative to the ring as a whole, the difficulty of manipulating the toy is decreased.

The shape of each pedestal holder may be selected to be substantially circular, as is the primary pedestal holder 16 of the embodiment illustrated in FIG. 1. However, as in the embodiments shown in FIGS. 4 and 5, the pedestal holders may have the shape of a selected straight-sided geometric shape so oriented relative to the connector 114 or 214 that the side 132, 133, 232, 233, or 234 of the geometric shape to which the pedestal 118, 119, 218, 219, 221, 223, 225, or 227 is attached is oriented at a substantially right angle to a line drawn from the point at which the user's finger contacts the manipulating ring through the center of gravity of the toy.

The primary and secondary manipulating rings, the connector, and the primary and secondary pedestal holders may be conveniently made from a heavy gauge of wire, from plastic, from plastic or rubber coated wire, or from any appropriately strong and rigid material. The pedestals may be made of glass, metal, plastic, or any other appropriate, solid material and may be fastened to the pedestal holders by glueing, welding, or other conventional means.

It is understood that the invention is not confined to the particular construction, materials, and arrangement of parts herein illustrated and described. Instead, it embraces all such modified forms thereof as come within the scope of the following claims.

I claim:

1. A toy adapted to be twirled on a finger of a user, comprising:

(a) a primary manipulating ring adapted to encircle the finger of the user of the toy in freely slidable relation, (b) a connector extending from the primary manipulating ring for a selected distance and rigidly connected thereto, (c) a substantially ring-shaped primary pedestal holder rigidly connected to the connector at a point remote from the primary manipulating ring, (d) a substantially spherical pedestal rigidly attached to the primary pedestal holder so as to substantially face the primary manipulating ring, (e) a balancing mass adapted to balance on the pedestal in removable relation, and (f) a retaining loop of flexible material fastened to the balancing mass and looped through the primary pedestal holder, whereby the retaining loop may slide about the primary pedestal holder while the balancing mass is prevented from falling free from the toy when it is not balanced on the pedestal.

2. A toy adapted to be twirled on a finger of a user, comprising:

(a) a primary manipulating ring adapted to encircle the finger of the user of the toy in freely slidable relation, (b) a connector extending from the primary manipulating ring for a selected distance and rigidly connected thereto, (c) a primary pedestal holder rigidly connected to the connector at a point remote from the primary manipulating ring, (d) a substantially spherical pedestal rigidly attached to the primary pedestal holder so as to substantially face the primary manipulating ring, and (e) a balancing mass adapted to balance on the pedestal in removable relation, whereby the balancing mass may be balanced on the spherical pedestal while the toy is twirled on a user's finger that is encircled by the primary manipulating ring.

3. A toy adapted to be twirled on a finger of a user, comprising:

(a) a primary manipulating ring adapted to encircle the finger of the user of the toy in freely slidable relation, (b) a connector extending from the primary manipulating ring for a selected distance and rigidly connected thereto, (c) a substantially ring-shaped primary pedestal holder rigidly connected to the connector at a point remote from the primary manipulating ring, (d) a pedestal rigidly attached to the primary pedestal holder so as to substantially face the primary manipulating ring, (e) a balancing mass adapted to balance on the pedestal in removable relation, and (f) a retaining loop of flexible material fastened to the balancing mass and looped through the primary pedestal holder, whereby the retaining loop may slide about the primary pedestal holder while the balancing mass is prevented from falling free from the toy when it is not balanced on the pedestal.

4. The toy specified in claim 1 including at least one secondary pedestal holder rigidly connected to the primary pedestal holder, a substantially spherical pedestal rigidly attached to each secondary pedestal holder so as to substantially face the primary manipulating ring, at least one balancing mass adapted to balance on each of the pedestals in removable relation, and a retaining loop fastened to each balancing mass and linked with the associated secondary pedestal holder.

5. The toy specified in claim 3 including at least one secondary pedestal holder rigidly connected to the primary pedestal holder, a pedestal rigidly attached to each secondary pedestal holder so as to substantially face the primary manipulating ring, at least one balancing mass adapted to balance on each of the pedestals in removable relation, and a retaining loop fastened to each balancing mass and linked with the associated secondary pedestal holder.

6. The toy specified in claims 1 or 2 wherein at least two substantially spherical pedestals are rigidly attached to the primary pedestal holder so as to substantially face the primary manipulating ring.

7. The toy specified in claims 1 or 2 wherein the substantially spherical pedestal has a flat surface of a selected size at a point of the spherical pedestal substantially facing the primary manipulating ring.

8. The toy specified in claims 1, 2, or 3 wherein the balancing mass has two parallel discs of substantially equal size and so oriented that opposing faces thereof are in parallel relation and separated by a distance at least as great as the minimum cross-sectional dimension of the retaining loop; the retaining loop has a selected length of flexible, thread-like material having two ends, both the ends extending between the two discs; and an adhesive filling the remaining space between the two discs, securing the ends and fastening the two discs and the retaining loop together.

9. The toy specified in claims 1, 2, or 3 wherein at least one secondary manipulating ring is rigidly attached to the primary manipulating ring at a point substantially opposed to the primary pedestal holder.

10. The toy specified in claims 1, 2, or 3 wherein the primary manipulating ring is substantially circular and the primary pedestal holder is substantially circular.

11. The toy specified in claims 1, 2, or 3 wherein the primary manipulating ring is a straight-sided geometric shape having points of intersection between contiguous sides and so oriented relative to the connector that a selected point of intersection between two of the sides is substantially opposed to the primary pedestal holder so as to form a twirling point, and the primary pedestal holder is a straight-sided geometric shape so oriented relative to the connector that the side of the geometric shape to which a pedestal is attached is oriented at a substantially right angle to a line drawn from the twirling point through the center of gravity of the toy.

12. The toy specified in claims 1, 2, or 3 wherein at least two secondary manipulating rings are rigidly connected in a substantially linear array and the substantially linear array is rigidly attached to the primary manipulating ring at a point substantially opposed to the primary pedestal holder.

13. The toy specified in claims 1, 2, or 3 wherein at least two secondary pedestal holders are rigidly connected to form a substantially linear array and are attached to the primary pedestal holder at a point substantially opposed to the primary manipulating ring.

14. The toy specified in claims 1 or 2 wherein at least two substantially spherical pedestals are rigidly attached to the primary pedestal holder so as to substantially face the primary manipulating ring, and at least one of the substantially spherical pedestals has a flat surface of a selected size at a point on the spherical pedestal substantially facing the primary manipulating ring while another of the spherical pedestals has a curved surface substantially facing the primary manipulating ring, whereby a user may select a particular degree of difficulty in using the toy by selecting the particular spherical pedestal on which to balance the balancing mass.

* * * * *